United States Patent [19]

Schreiner

[11] Patent Number: 4,582,463

[45] Date of Patent: Apr. 15, 1986

[54] FLUID PRESSURE OPERATED STACK ELEVATING DEVICE

[75] Inventor: Martin Schreiner, New Hall, Calif.

[73] Assignees: The Singer Company, Stamford, Conn.; AVG Productions, Inc., Valencia, Calif.

[21] Appl. No.: 620,989

[22] Filed: Jun. 15, 1984

[51] Int. Cl.[4] ..... B65H 1/16

[52] U.S. Cl. ..... 414/118; 92/34; 92/90; 221/198; 221/279; 254/93 HP; 271/147; 271/164; 414/100

[58] Field of Search ..... 414/98, 99, 100, 117, 414/118, 119; 92/34, 36, 40, 89, 90, 92, 93; 187/8.41, 8.71, 8.72, 18; 254/93 HP; 271/147, 160, 162, 164, 217, 219; 221/198, 279; 222/386.5

[56] References Cited

U.S. PATENT DOCUMENTS

| | | | |
|---|---|---|---|
| 1,986,273 | 1/1935 | Leffingwell | 254/93 HP |
| 3,253,824 | 5/1966 | Southwell et al. . | |
| 3,709,380 | 1/1973 | Cole | 414/663 |
| 4,187,077 | 2/1980 | Covington et al. | 221/198 X |
| 4,339,221 | 7/1982 | Mitzel et al. | 414/417 X |

FOREIGN PATENT DOCUMENTS

| | | | |
|---|---|---|---|
| 1230042 | 12/1966 | Fed. Rep. of Germany | 271/217 |
| 2511687 | 9/1976 | Fed. Rep. of Germany | 92/40 |
| 56-139479 | 10/1981 | Japan . | |
| 1239616 | 7/1971 | United Kingdom | 414/99 |

*Primary Examiner*—Leslie J. Paperner

*Attorney, Agent, or Firm*—Robert E. Smith; Edward L. Bell; David L. Davis

[57] ABSTRACT

A fluid pressure operated stacking device with a frustoconically shaped inflatable bladder accommodated with clearance within a housing into which a stack container with stack embracing sidewall panels is insertable with the stack container panels arranged in the clearance space between the housing and the bladder.

5 Claims, 3 Drawing Figures

FLUID PRESSURE OPERATED STACK ELEVATING DEVICE

DESCRIPTION

Background of the Invention

This invention relates to a device for supporting and manipulating a stack of similarly shaped plys of material so as to accept, dispose or deliver the topmost ply of material in a predetermined plane for cooperation with associated material handling apparatus.

Devices of this general description, frequently referred to as stackers, are known in which screw thread operated mechanisms of fluidic cylinder and piston devices are employed to influence stack elevation. A drawback experienced with these known stackers is that considerable space is required beneath the stack for the stack elevating screw mechanism and drive therefor or the cylinder and piston device. Particularly where the elevation of the topmost ply of material on the stack is prescribed, the space required by the known elevating mechanisms imposes a severe limitation on the total capacity of the stacker unit.

It is an object of this invention to provide a stack elevating device employing an elevating means which occupies only an exceedingly small and insignificant space beneath the stack and thus can accommodate a maximum stack height which is particularly advantageous where the elevation of the topmost ply of material on the stack is prescribed. This object of the invention is attained by the provision of an inflatable flexible bladder beneath the stack together with means for delivering fluid medium under controlled pressure into the bladder to influence the stack elevation.

For influencing predetermined orientation of the plys of material in the stack, a rigid walled guide chamber having cross-sectional shape conforming to that of the plys to be manipulated is desirable. An inflatable flexible bladder configuration with engages or is otherwise constrained and supported by the walls of the guide chamber has been found to be unsatisfactory not only because the abrasion between the bladder and the guide chamber walls drastically reduces bladder life, but because friction between the bladder and guide chamber walls can cause folds which form in the flexible bladder to become wedged between the stack and the guide chamber walls thus to jam the stacker and possibly cause injury to the various components.

A flexible bladder is thus called for which is free standing when inflated, that is, which is unsupported laterally by sidewalls of any guide chamber or the like.

A free standing straight cylindrical bladder, however, has been found to be unsatisfactory when its height must exceed its girth. Under such a condition a straight cylindrical bladder has been found to be prone to failure in column strength so that, as its height increases, a point is reached where the bladder bends to one side causing the elevation of the topmost ply in the stack to decrease erratically, destroying smooth continuity of stack elevation, placing abnormal demands on the fluid pressure controls, and giving rise to undesirable wear and jam possibilities associated with contact of the bladder with guide wall surfaces.

It is another object of this invention to provide a free standing flexible bladder shape which is exceedingly stable and strong in column strength and which will resist buckling even when its height to minimum girth ratio exceeds that at which a straight cylindrical bladder of the like construction in all other respects will buckle.

This object of the invention is attained by the provision of a free standing flexible bladder which when inflated exhibits a frusto conical shape.

Such frusto conical flexible bladder shape also contributes to the attainment of the first mentioned object of this invention in that upon collapsing as fluid pressure within is reduced, a frusto conical bladder will form successive folds which are successively concentric rather than vertically stacked as in the case of a cylindrically shaped bladder, and such concentric folds occupy significantly less space beneath the stack.

With the above and additional objects and advantages in view as will hereinafter appear, this invention will best be understood from the following description of a preferred embodiment when read in conjunction with the accompanying drawings in which.

DESCRIPTION OF THE PREFERRED EMBODIMENT

Figure 1:
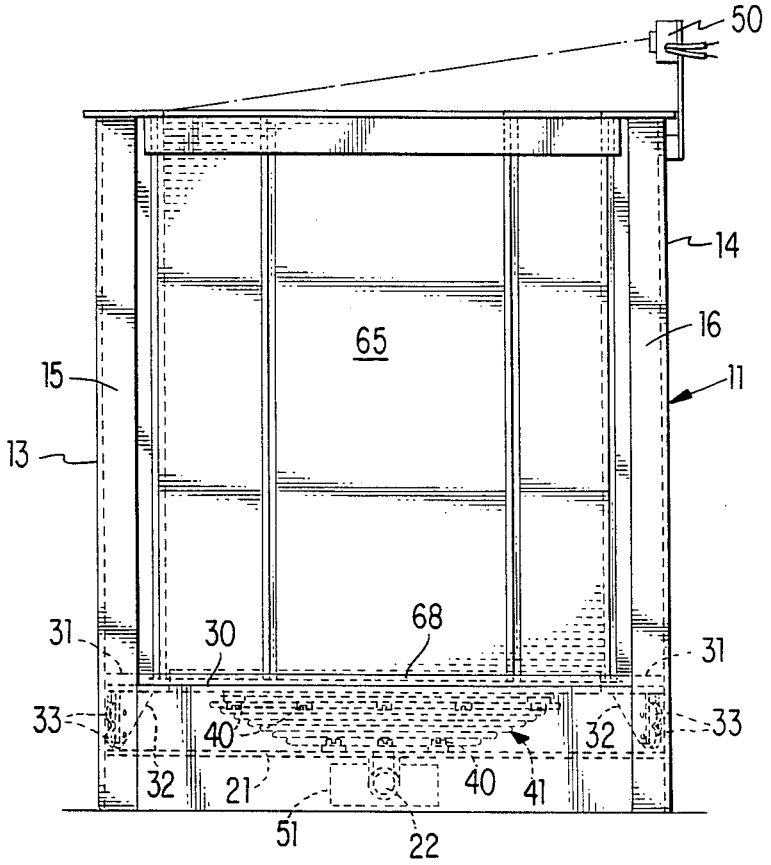
FIG. 1 is an elevational view partly in vertical cross-section of a stacking device in accordance with this invention shown supporting a substantially full stack of superposed plys of material.

Referring to the drawings, the stacking device of this invention is preferrably arranged in a three sided housing 11 including a rear panel 12 and side panels 13 and 14 each of which is formed at the front with an inturned lip 15 and 16, respectively, so that the housing defines four inside corners 17, 18, 19 and 20 vertically arranged and substantially parallel to each other. Near the bottom, each of the panels 12, 13 and 14 is joined by a horizontal partition 21 upwardly through the center of which extends a conduit 22 from a source (not disclosed) of fluid under pressure.

Slightly above the partition 21, each of the housing panels 12, 13 and 14 carries a trapezoidally shaped shelf 23 and a similarly trapezoidally shaped shelf 23 is secured extending between the lips 15 and 16. The space 23 between the beveled side edges of each pair of contiguous trapeziodally shaped shelves 23 defines a channel 24 leading diagonally to a respective one of the inside corners 17 to 20 of the housing 11. A narrow front skirt 25 may be provided extending downwardly from the shelf 23 spanning the lips 15 and 16.

Carried within the housing 11 is a vertically traveling platform 30 formed at each corner with an outward diagonally extending arm 31, which arms match in configuration the channels 24 so as to pass with clearance therethrough. Brackets 32 secured one to each of the platform arms 31 each carry vertically spaced rollers 33 which are constrained each in one of the inside corners 17 to 20 of the housing 11.

Figure 2:
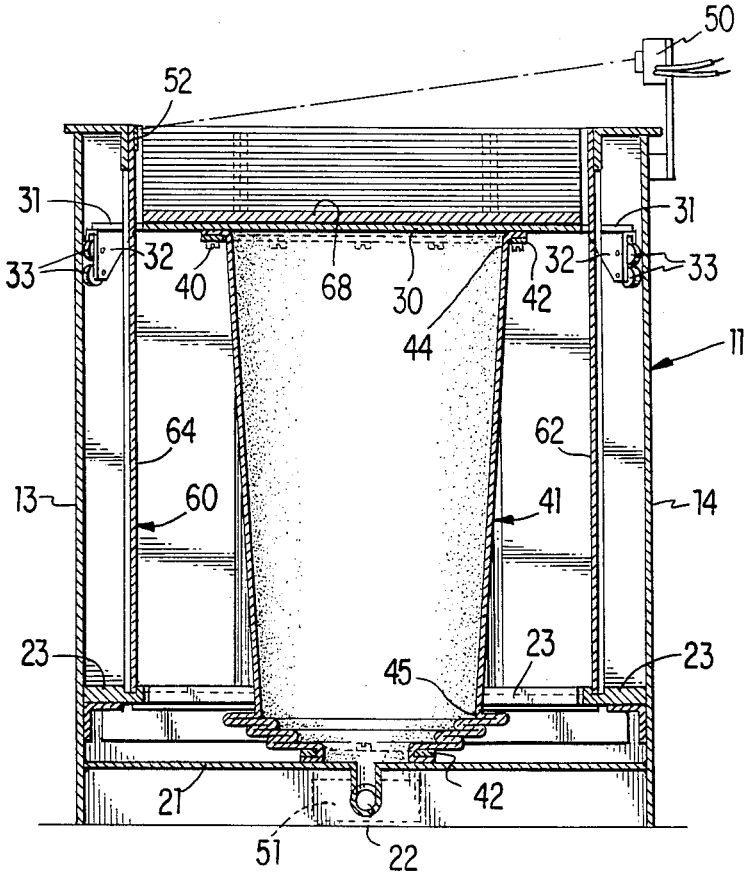
FIG. 2 is an elevational view similar to FIG. 1, but shown elevating a substantially depleted stack of superposed plys of material.
Figure 3:
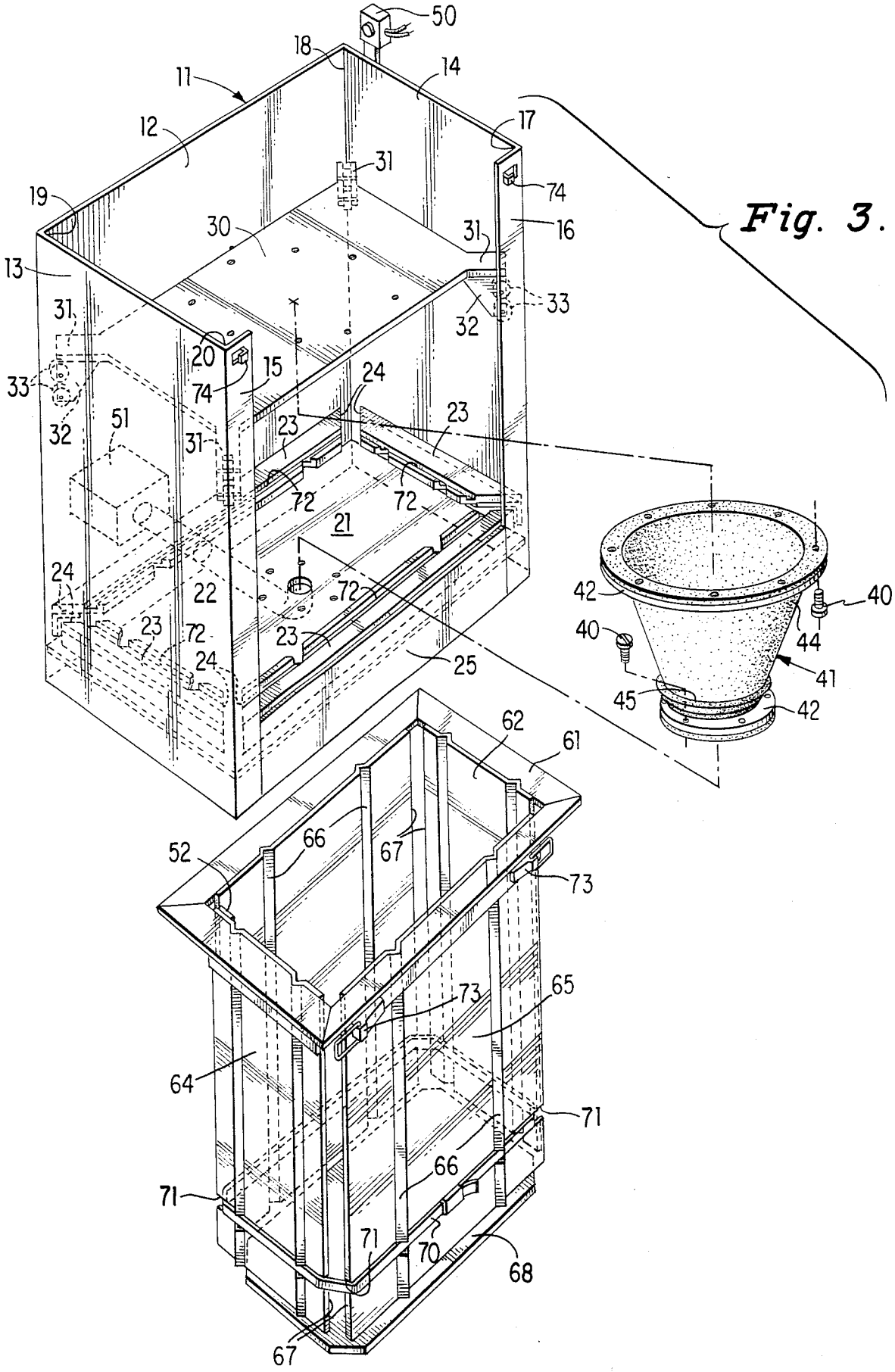
FIG. 3 is an exploded perspective view of the stacking device of FIGS. 1 and 2.

Fastening means 40 engage both the underside of the traveling platform 30 and the upper surface of the partition 21 for establishing a fluid tight connection between each of the surfaces and a respective one extremity of a flexible inflatable bladder 41. Any suitable gaskets 42 may be employed to effect these fluid tight connections. As shown in FIGS. 2 and 3, the bladder 41 is preferably in the form of a frustum of a cone with the large diameter extremity 44 affixed beneath the traveling platform 30 and the small diameter extremity 45 affixed to the partition 21 in a location surrounding the conduit 22.

For elevating a stack of plys, which when full, may weigh several hundred pounds, a free standing bladder, that is, one which is completely unsupported laterally and is 22 inches in diameter at the top and 11 inches in diameter at the bottom has been found operative to elevate the platform to a height of 40 inches without any buckling.

When coupled with control instrumentalities, the specific details of which are known per se in the art, the stacking device thus far described is capable of functioning to elevate the uppermost ply of a stack of material plys on the traveling platform 30 accurately to a predetermined level. The required control instrumentalities include a sensing device 50 responsive to the presence of the uppermost ply in the stack at the predetermined level, and suitable valve and control apparatus 51 responsive to the sensing device 50 to effect flow of fluid to the bladder and control of the pressure therein sufficient to elevate the stack to the required degree. Contact devices which employ an arm physically engaged by the topmost ply of the stack to signal attainment of the predetermined level thereof may be employed, or as illustrated, a photo electric sensing device 51 may be used responsive to the continuity of a light beam between the sensing device 50 and a reflective surface 52 which may be carried by the housing 11 at the opposite side of the stack. Such a photo electric device will discontinue fluid pressure increase to the bladder whenever anything including the presence of the uppermost material ply on the stack breaks the continuity of the light beam. Similar controls for lowering the platform 21 may be employed or a manually operated valve (not shown) may be used to bleed pressure from the bladder for effecting descent of the platform 21 when desired.

Although the stacking device as thus far described is capable of functioning satisfactorily, the inflatable bladder as described above and particularly the free standing anti-buckling characteristics of the bladder make possible an additional highly advantageous arrangement facilitating the handling of stacks of material plys.

As shown in the drawings, 60 indicates a ply stack container which may be pre-loaded with material plys at a remote location from the housing 11, stored, transported as by lift truck to the housing 11, and inserted bodily into the housing remaining therein during gradual elevation of the stack without any adverse effect on the operation or accuracy of operation of the stack elevating device.

The stack container 60 is formed at the top with a continuous rim 61 to which four depending side panels 62, 63, 64 and 65 are secured. Each side panel is preferably formed with vertical stiffening projections 66 and the panels are arranged such that a vertical clearance 67 exists between each adjacent panel providing for accommodation of the platform arms 31 as the stack is elevated. A flat supporting plate 68 having substantially the same shape as the material plys to be accommodated thereon is arranged within the panels. The panels may be straight or somewhat curved to match the material ply shape. Preferably, the panels 62 to 65 snuggly embrace the stack of material plys placed on the plate 68 therein and serve to maintain a neat predetermined orientation of the stack of plys not only during transport to the vicinity of the housing and storage awaiting insertion therein, but also during the entire period of stack elevation by the stacking device. During storage and transport a retaining strap 70 directed around the lower extremity of the panels 62 to 65 and engaged in notches 71 formed on opposite sides of each panel serves to retain the plate 68 and any material plies thereon from dropping out of the container 60 and also serves to retain the panels 62 to 65 snuggly against the ply stack.

Upon insertion of a fully loaded container 60 into the housing 11 through the opening between the lips 15 and 16, the bottom edges of the container panels 62 to 65 may be lowered into depressions 72 in the shelves 23 and latch devices 73 on the container rim 61 may be interlocked with mating latch hooks 74 on the housing 11 to secure the container in place. Thereafter the retaining strap must be removed to clear passageways for the platform arms 31, after which the stacking device is readied for operation.

I claim:

1. In a stack elevating device having a housing with a floor partition, a platform arranged in said housing above said floor partition for supporting a vertical stack of material plys, means in said housing guiding said platform for movement vertically therein, and means for maintaining an uppermost ply of said vertical stack of material plys at a predetermined elevation above said floor partition, said last named means comprising:

a flexible inflatable bladder of frusto conical shape, means securing the smaller extremity of said bladder on said housing floor partition and the larger extremity of said bladder beneath said platform, said housing providing a clearance space on all sides of said bladder and being free of any lateral supporting contact with said bladder between the extremities thereof in any degree of bladder inflation; and conduit means for delivering fluid to said bladder, and means for influencing the pressure of said fluid in said bladder, said pressure influencing means providing the only control of the bladder extension as the number of material plys in said stack changes.

2. A stack elevating device as set forth in claim 1 including means for sensing presence of the topmost ply of material on said platform at a predetermined elevation, and means responsive to said sensing means for influencing the fluid pressure delivered into said bladder through said conduit means.

3. A stack elevating device as set forth in claim 1 in which said frusto conical bladder shape is proportioned so as to provide a large extremity with substantially four times the cross-sectional area as that of the small extremity.

4. A stack elevating device as set forth in claim 3 in which the extended height of the frusto conical bladder is substantially four times the diameter of the small extremity of said bladder.

5. A stack elevating device comprising:

a housing with a floor partition, a platform arranged in said housing above said floor partition for supporting a stack of material plys, a flexible inflatable bladder of frusto conical shape, means securing the smaller extremity of said bladder on said housing floor partition and the larger extremity of said bladder beneath said platform, said housing providing a clearance space on all sides of said bladder and being free of any lateral supporting contact with said bladder between the extremities thereof in any degree of bladder inflation;

and conduit means for delivering fluid under controlled pressure into said bladder, platform guiding means in said housing comprising paralled vertical guide tracks formed on housing outwardly of said clearance space between said housing and said bladder, in which said platform includes arms radiating through said clearance space, each arm carrying means of cooperating with one of said guide tracks, a stack container separate from said housing and having sidewall panels snuggly embracing a stack of material plys to be elevated by said stack elevating device, means securing said stack container within said housing with said stack container panels arranged in said clearance space between said housing and said bladder, and in which said stack container includes an upper rim and means securing said sidewall panels to said rim with spaces therebetween providing clearance for vertical travel of said platform arms.

* * * * *